United States Patent [19]

Holland

[11] 4,043,290

[45] Aug. 23, 1977

[54] WATER SKI TOW HANDLE

[76] Inventor: Dennis P. Holland, 3599 Orchard Lake Road, Orchard Lake, Mich. 48033

[21] Appl. No.: 733,413

[22] Filed: Oct. 18, 1976

[51] Int. Cl.[2] ..... B63B 21/56

[52] U.S. Cl. ..... 115/6.1

[58] Field of Search ..... 115/6, 6.1, 7; 9/310 A; 114/253, 254; 289/1.2, 2, 13, 15, 17, 18

[56] References Cited

U.S. PATENT DOCUMENTS 3,930,460 1/1976 Beck ..... 115/6.1

*Primary Examiner*—Trygve M. Blix

*Assistant Examiner*—D. W. Keen

*Attorney, Agent, or Firm*—Gifford, Chandler, Sheridan & Sprinkle

[57] ABSTRACT

A tow rope handle for water skiing or the like comprising an elongated hand grip with a pair of spaced holes extending transversely therethrough, a tow line threaded through each spaced hole and formed in a loop to firmly encircle the hand grip and a protective sleeve encompassing each tow line directly adjacent the hand grip. The sleeve is formed integrally with the hand grip and has a hole extending transversely therethrough, each tow line loop encircling the hand grip through the corresponding sleeve hole.

16 Claims, 9 Drawing Figures

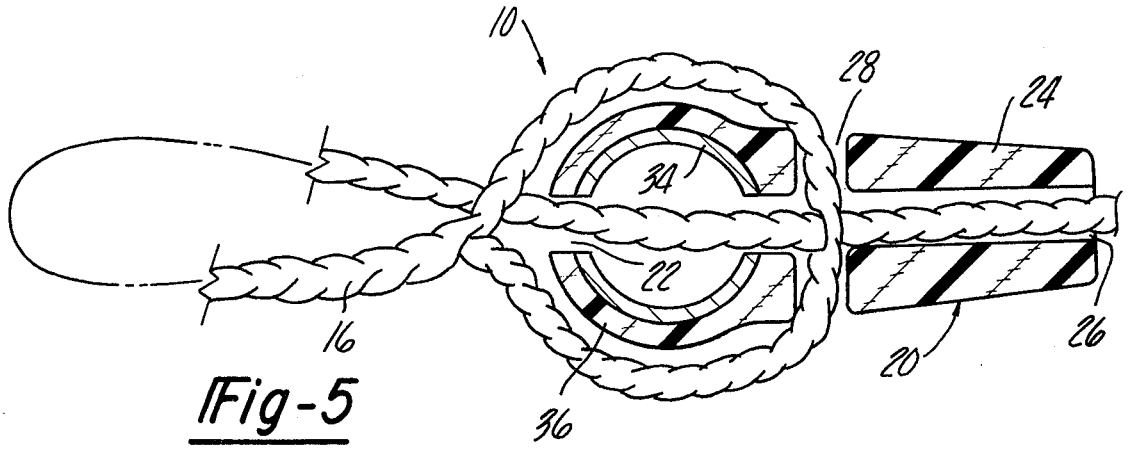
Fig-5
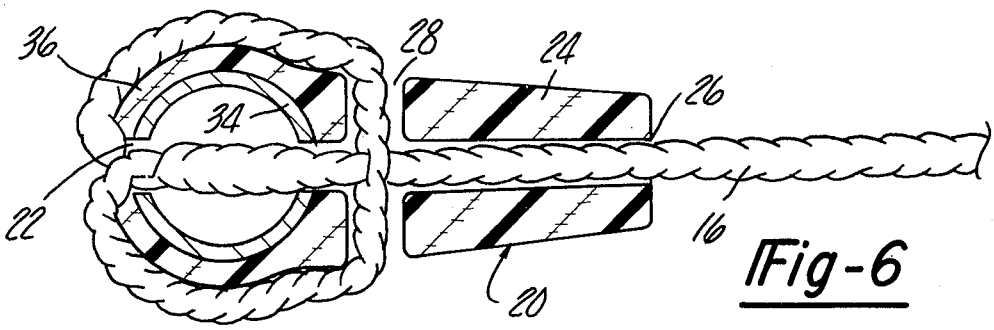
Fig-6
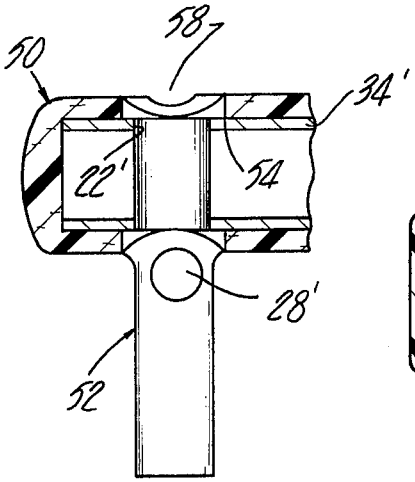
Fig-7
Fig-8
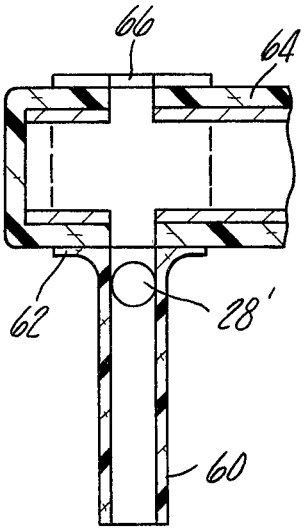
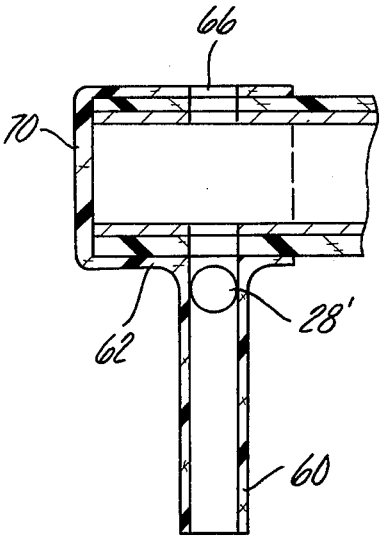
Fig-9

WATER SKI TOW HANDLE

BACKGROUND OF THE INVENTION

1. Field of the Invention

The present invention relates to rope handles, and particularly to a tow rope handle specifically adapted for use in water skiing or the like.

2. Description of the Prior Art

Typical prior water ski tow rope handles are disclosed in the following U.S. Pat. Nos. Brownson 3,092,068 and 3,537,418, Stein 3,695,210 and Beck 3,930,460,

SUMMARY OF THE PRESENT INVENTION

It is an object of the present invention to provide a rope handle which is economical to manufacture and assemble, which is durable in operation, compact and neat in appearance and/or which is particularly well adapted for use in water skiing or the like. More specifically, it is an object of the present invention to provide a water ski tow rope handle which will rest comfortably in a skier's hands and/or which protects the skier's hands against chafing or entanglement with the tow line.

BRIEF DESCRIPTION OF THE DRAWINGS

The invention, together with additional objects, features and advantages thereof, will be best understood and appreciated from the following description when read in conjunction with the accompanying drawings in which:

FIGS. 3–6 are sectional views of the tow rope handle and illustrate successive stages in the attachment of a tow line to the handle, FIG. 6 being taken along the line 6—6 of FIG. 1; and FIGS. 7–9 are broken axial sectional views illustrating respective alternative embodiments of the handle provided by the invention.

DETAILED DESCRIPTION OF THE PRESENT INVENTION

Figure 1:
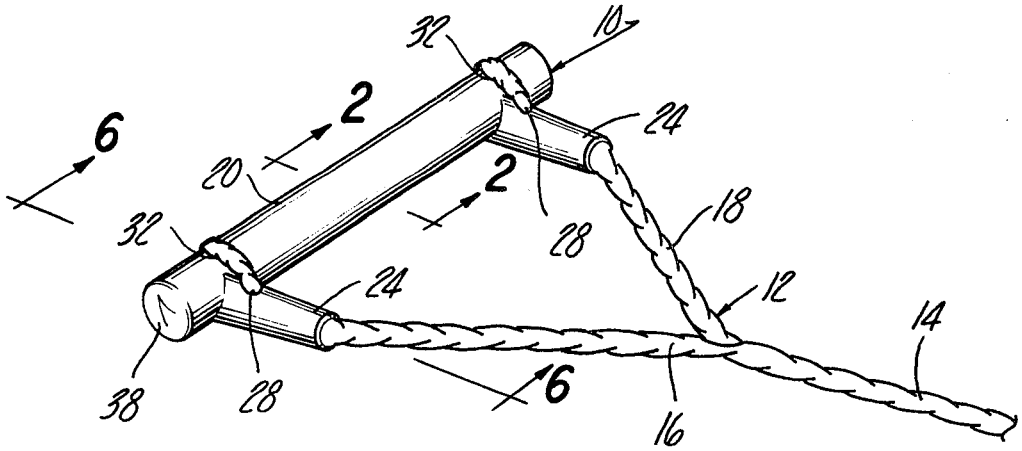
FIG. 1 is a perspective view of a presently preferred embodiment of the tow rope handle provided by the invention attached to a ski tow line.
Figure 2:
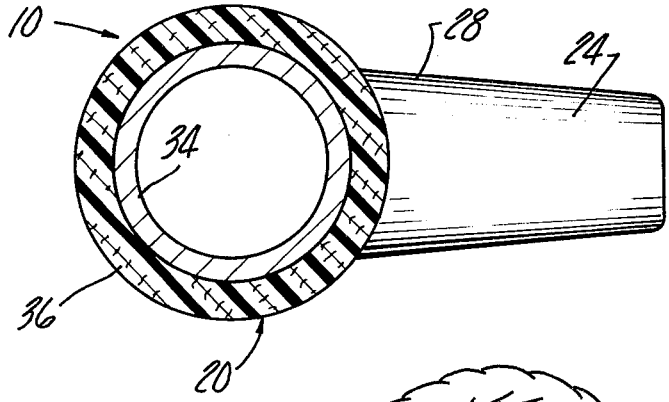
FIG. 2 is a sectional view of the handle illustrated in FIG. 1 and is taken along the line 2—2 of FIG. 1.

Referring to FIGS. 1, 2 and 6, a tow rope handle 10 in accordance with the invention bridges and is connected to a Y-shaped tow line 12 having an extended free end for connection to a ski tow boat (not shown). Tow line 12 preferably comprises an extended integral length 14 of conventional hollow braided flexible thermoplastic material, such as nylon, connected at one end 16 to handle 10, and a shorter length 18 of similar material connected at one end to handle 10 and attached at the other end to length 14 to form the above-mentioned Y-shaped configuration. Handle 10 comprises an elongated hand grip section 20 having a pair of holes 22 (FIG. 6) extending transversely therethrough near the hand grip ends. A pair of sleeves 24 encompass respective tow line ends 16, 18 to protect the hands of a skier from chafing against or becoming entangled with the tow line. As best seen in FIG. 6, the axial bore 26 of each sleeve 24 is aligned with a corresponding hole 22 to admit the associated end of tow line 12. A hole 28 extends transversely through each sleeve 24 adjacent hand grip 20 and intersects corresponding sleeve bore

26 (FIG. 6) at substantially a right angle. Holes 28 are also substantially perpendicular to the longitudinal axis of handle 10.

Handle 10, i.e., hand grip 20 and sleeves 24, is preferably formed as an integral unit comprising a hollow cylindrical metal tube 34 coated with a relatively thick layer 36 of molded resilient material. Sleeves 24 are entirely formed of resilient material and are formed during the molding process. As seen in FIG. 6, holes 22 extend through metal tube 34. Preferably, the ends of tube 34 are closed by molded material, as best seen at 38 in FIG. 1. Hence, handle 10 with integral sleeves 24 can be formed in a single step molding operation. In one embodiment of the invention in which tube 34 comprises a three-quarter inch (O.D.) aluminum tube having a wall thickness of 0.083 inch, material 36 comprises a one-eighth inch layer of a rubber and cork mixture which provides a water-resistant nonslip gripping surface. The particular rubber/cork mixture was developed by Master Grip, Inc. of Wadsworth, Ohio and has been used by that manufacturer for golf club grips. As best seen in FIG. 2, hand grip 20 is ovate in radial cross section, with the narrowing portion of such cross section extending in a direction parallel to holes 22 and sleeves 24 for firm and comfortable gripping by a skier.

Figure 3:
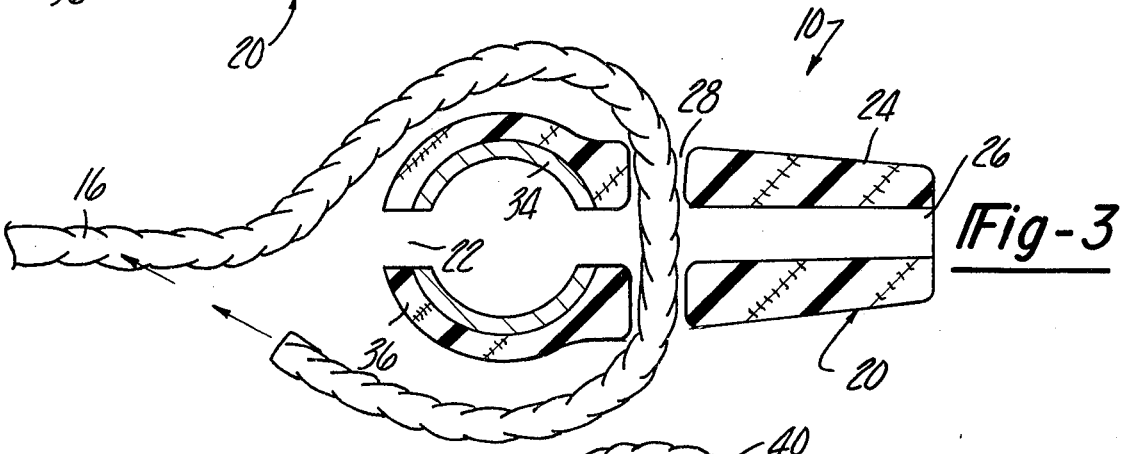
Figure 4:
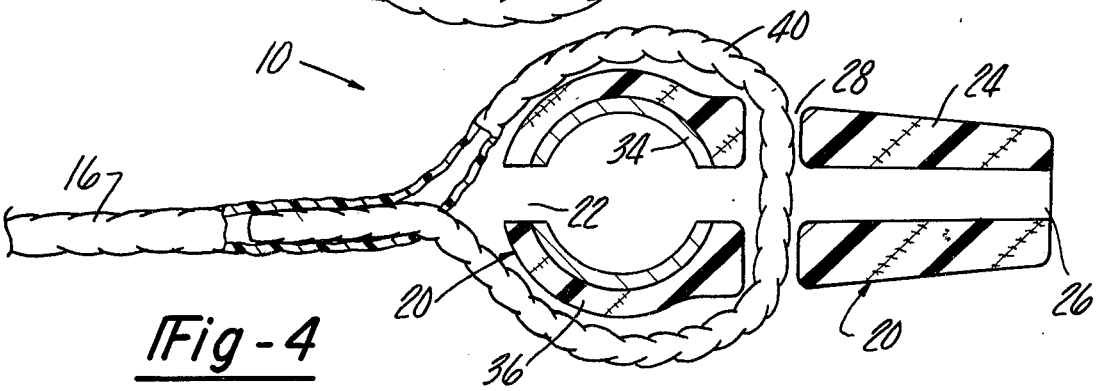

The method for attaching tow line 12 to handle 10 will be best understood with reference to FIGS. 3–6. Considering line end 16 initially, the line is first fed through sleeve hole 28 as illustrated in FIG. 3, and then threaded into itself as shown in FIG. 4 to form a closed loop 40 encircling hand grip 20. The free end of the tow line is then fed through hole 22 in the hand grip and into sleeve bore 26. Preferably, such free end is threaded through that portion of loop 40 which extends through sleeve hole 28, as shown in FIG. 5. The free line end is then drawn taut, such that loop 40 firmly encircles and tightly grips handle 10 in channel 32, as shown in FIG. 6. The hollow braided tow line operates in a manner similar to the familiar Chinese finger tow which loosely receives a persons finger when the toy is axially compressed but tightly grips the finger when tension is applied. Thus, tension on the extending portion of line end 16 not only tightens loop 40 about grip 20 but also tightens the grip of the line upon itself at end 16 (FIGS. 4 and 6). Line section 18 (FIG. 1) is attached to handle 10 in an identical manner. Line sections 16, 18 are then joined by passing line 18 into line 16 to effectuate a "Chinese finger" grip, or by passing line 18 completely through line 16 and terminating line 18 in a knot.

Advantages of the preferred embodiment of the invention thus described will be appreciated with reference to FIG. 1. In addition to the obvious economic advantages of providing a one-piece handle which may be directly attached to the tow line, it will be noted that a skier's hands, which are normally placed in the central region of hand grip 20, are protected from chafing against line 12 by the cooperative action of sleeves 24. More specifically, provision of sleeve hole 28 allows sleeve 24 to encompass the tow line directly adjacent and, preferably, integrally with the hand grip. Thus the sleeves 24 effectively separate the tow line from a skier's hands in the area of the handle. Without sleeve holes 28, loops 40 would have to encircle hand grip 20 externally of the sleeves in the manner illustrated in the latter above-referenced Brownson patent or the sleeves would have to be spaced from the hand grip to accommodate the loop as shown in the above-referenced Beck patent, in either of which cases a portion of the tow line would be exposed to the skier's hand. Stated differently, with the arrangement of the present invention, the anti-chafing sleeves can be positioned with one end directly against and in engagement with the hand grip without separation therefrom or interference with the loop. Of course, in the preferred embodiment the anti-chafing sleeve is integral with the hand grip. Moreover, sleeves 24 rigidly direct and hold line 12 away from hand grip 20 so as to reduce the danger of the low line becoming entwined with the skier's fingers when the line slackens.

From the foregoing description it will be apparent that the tow rope handle provided herein fully satisfies all of the objects and aims previously set forth. Although the invention has been thus far described in connection with a presently preferred embodiment thereof, many alternatives and modifications will be apparent. For example, referring to FIGS. 7–9, the hand grip and sleeves may be provided as separate units. Referring specifically to FIG. 7, separate sleeve members 52 of rubber and cork material may be axially press-fitted into the transverse holes of a coated metal tube to form a hand grip 50. Sleeve member 52 may have a head 54 which snaps through the hole 22' in tube 34' as shown in FIG. 7. When the tow line loop is formed, the sleeve 52 is also retained on the grip by the loop. Alternatively, sleeve 52 may be loosely fitted in the transverse hole and terminate internally of the tube. Such a sleeve will be held firmly against the hand grip by the encircling tow line loop that passes through the transverse sleeve hole 28'. Indeed, sleeve 52 may merely abut but not extend into hand grip 50 and be firmly held in abutment by the encircling loop. However, at least some degree of interengagement between the sleeve and hand grip is preferred for purposes of stability.

Referring to FIG. 8, sleeve 60 may be formed integrally with a hollow cylindrical collar 62 adapted to firmly but removably encompass a coated hand grip 64. A hole 66 is formed in the collar 62 for alignment with the transverse holes in the hand grip. As further modification of the embodiment of FIG. 8, a hand grip end cap 70 may be formed integrally with collar 62 as shown in FIG. 9. Each of the sleeves 52, 60 in FIGS. 7–9 has a hole formed transversely therethrough to accommodate a tow line loop 40 in the manner illustrated in FIG. 6 so as to provide the same compact and neat appearance about the handle. In the embodiments of FIGS. 7–9, sleeves 52, 60 can be molded of suitable plastic material. It is also possible, of course, to provide a tow rope handle in accordance with the invention having only two transverse rope-attachment holes extending therethrough equidistantly from the handle ends and, thus, having only one anti-chafing sleeve 24 extending therefrom. However, the two-hole arrangement of FIG. 1 is preferred. The invention is intended to embrace the above-noted and all other alternatives, modifications and variations as fall within the spirit and broad scope of the appended claims.

The invention claimed is:

1. In a tow rope arrangement for water skiing which includes an elongated hand grip having friction material thereon and at least one hole extending transversely therethrough, a tow line threaded through said hole and terminating in a loop firmly encircling said hand grip and a protective sleeve having an axial bore encompassing said tow line, the improvement comprising a hole extending transversely through said sleeve, said loop encircling said hand grip through said hole in said sleeve such that said sleeve also encompasses a portion of said tow line loop directly adjacent said hand grip.

2. The improved tow rope set forth in claim 1 wherein said hole extending transversely through said sleeve intersects said bore.

3. The improved tow rope set forth in claim 2 wherein the axis of said hole extending transversely through said sleeve intersects the axis of said bore at substantially a right angle and said sleeve hole is also directed generally transversely in a longitudinal axis of said hand grip, said tow line passing through said at least one hole and said sleeve being interweaved in said sleeve with tow line passing through said hole extending transversely through said sleeve.

4. The improved tow rope set forth in claim 3 wherein said hand grip is ovate in radial cross section, the narrowing portion of said cross section extending in a direction parallel to said at least one hole.

5. The improved tow rope set forth in claim 1 wherein said hand grip includes parallel holes extending transversely through each end of said hand grip, a tow line threaded through each of said parallel holes and a protective sleeve encompassing each said tow line, each said tow line terminating in a loop firmly encircling said hand grip through a transverse hole in the corresponding sleeve.

6. The improved tow rope set forth in claim 1 wherein said hand grip comprises a hollow aluminum tube and a resilient casing molded around said tube, said casing comprising a mixture of cork and rubber material.

7. The improved tow rope set forth in claim 1 wherein said hand grip and said sleeve comprise an integral unit in which said bore of said sleeve is axially aligned and directly communicates with said at least one hole in said hand grip.

8. The improved tow rope set forth in claim 1 further comprising a collar integral with said sleeve and adapted to encompass said hand grip, said collar having a hole formed transversely therethrough in alignment with said sleeve bore and said at least one hole in said hand grip.

9. The improved tow rope set forth in claim 8 wherein said collar is closed at one end to form an end cap on said handle.

10. The improved tow rope set forth in claim 1 wherein said sleeve comprises a separate member having an end axially fitted into said at least one hole in said hand grip.

11. In a tow handle for water skiing which includes the combination of an elongated hand grip with at least one hole extending transversely therethrough for attachment of a tow line to said handle and a protective sleeve for encompassing the tow line, the improvement comprising a hole extending transversely through said sleeve and adapted to receive an end of a tow line such that the tow line may be threaded through said hole in said sleeve and then through said hole in said hand grip and formed into a loop firmly encircling said hand grip, said sleeve encompassing said tow line directly adjacent said hand grip.

12. The improved tow handle set forth in claim 11 wherein said hand grip and said sleeve are formed as an integral unit, said sleeve extending radially from said hand grip and having an axial bore aligned with said at least one hole in said hand grip.

13. The improved tow handle set forth in claim 11 wherein said hand grip includes parallel holes extending transversely through opposite ends of said hand grip and two protective sleeves extending from said hand grip coaxially with respective holes in said hand grip.

14. The improved tow handle set forth in claim 13 wherein said handle comprises a hollow aluminum tube having said parallel holes extending therethrough and a casing of resilient material molded onto said tube.

15. The improved tow handle set forth in claim 14 wherein said casing comprises a mixture of cork and rubber material.

16. The improved tow handle set forth in claim 11 wherein said hand grip includes parallel holes extending transversely through opposite ends of said hand grip and a protective sleeve aligned with each said hole in said hand grip for encompassing a corresponding end of a tow line.

* * * * *